US008262205B2

(12) United States Patent
Kaga

(10) Patent No.: US 8,262,205 B2
(45) Date of Patent: Sep. 11, 2012

(54) LIQUID DISCHARGE DEVICE

(75) Inventor: Hikaru Kaga, Aisai (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 993 days.

(21) Appl. No.: 12/005,758

(22) Filed: Dec. 28, 2007

(65) Prior Publication Data

US 2008/0158312 A1 Jul. 3, 2008

(30) Foreign Application Priority Data

Dec. 29, 2006 (JP) ..... 2006-356900

(51) Int. Cl.
*B41J 2/175* (2006.01)
*B41J 2/17* (2006.01)

(52) U.S. Cl. ..... 347/85; 347/84

(58) Field of Classification Search ..... 347/84, 347/85

See application file for complete search history.

(56) References Cited

U.S. PATENT DOCUMENTS

| | | | | |
|---|---|---|---|---|
| 5,963,237 | A | 10/1999 | Ikkatai et al. | |
| 6,022,102 | A | 2/2000 | Ikkatai et al. | |
| 6,276,784 | B1 | 8/2001 | Ikkatai et al. | |
| 6,390,611 | B1 * | 5/2002 | Kobayashi et al. | 347/84 |
| 6,866,372 | B2 | 3/2005 | Oda et al. | |
| 6,966,641 | B2 | 11/2005 | Taniguchi et al. | |
| 2003/0038865 | A1 | 2/2003 | Inamura | |
| 2005/0212874 | A1 | 9/2005 | Nomura et al. | |
| 2006/0028519 | A1 | 2/2006 | Nakamura et al. | |
| 2006/0170739 | A1 | 8/2006 | Koga et al. | |
| 2007/0115329 | A1 * | 5/2007 | Takatsuka | 347/57 |

FOREIGN PATENT DOCUMENTS

| | | |
|---|---|---|
| JP | 10-029318 | 2/1998 |
| JP | 10-309806 | 11/1998 |
| JP | 2000-343722 | 12/2000 |
| JP | 2002-154218 | 5/2002 |
| JP | 2002-361894 | 12/2002 |
| JP | 2003-053996 | 2/2003 |
| JP | 2006-205690 | 8/2006 |

OTHER PUBLICATIONS

U.S. Appl. No. 12/005,988, filed Jul. 3, 2008, Brother KKK.

* cited by examiner

*Primary Examiner* — Matthew Luu
*Assistant Examiner* — Jannelle M Lebron
(74) *Attorney, Agent, or Firm* — Frommer Lawrence & Haug LLP

(57) ABSTRACT

A liquid discharge device is provided with a discharge head, a sub tank, and a liquid replenishment device comprising a space for housing a main tank and a joint member to be connected to the main tank. The joint member is capable of being connected to and disconnected from the sub tank. The liquid within the main tank is supplied to the sub tank when the joint member is in a connected state with the sub tank. The joint member comprises a liquid path and a valve biased in a direction where the liquid path is closed. The joint member is configured to receive a force from the sub tank and open the liquid path in the case where the joint member is being connected to the sub tank. The joint member is configured to open the liquid path in the case where an inner space of the main tank has a negative pressure greater than a first value.

15 Claims, 10 Drawing Sheets

LIQUID DISCHARGE DEVICE

CROSS-REFERENCE TO RELATED APPLICATION

This application claims priority to Japanese Patent Application No. 2006-356900, filed on Dec. 29, 2006, the contents of which are hereby incorporated by reference into the present application.

BACKGROUND OF THE INVENTION

1. Field of the Invention

The technique taught in the present specification relates to a liquid discharge device. This technique relates to, for example, an ink jet recording device that records an image onto a recording medium by discharging ink from a discharge head.

2. Description of the Related Art

An ink jet recording device of station supply type is taught in, for example, US Patent Application Publication No. 2006/0170739. The ink jet recording device is provided with a discharge head that has nozzles, a sub tank that stores ink to be supplied to the discharge head, and a main tank that stores ink to be supplied to the sub tank. In the case where it has become necessary to replenish ink into the sub tank, the main tank is connected with the sub tank via an ink supply tube. The ink within the sub tank can thus be replenished from the main tank.

BRIEF SUMMARY OF THE INVENTION

A large negative pressure may be formed within the main tank when a temperature change or the like occurs in the device. In this case, the negative pressure may pass into the sub tank when the main tank is connected to the sub tank, and there is a possibility that a meniscus in a nozzle of the discharge head connected with the sub tank will be destroyed. In the present specification, the term 'negative pressure' refers to an absolute value of a pressure that is less than atmospheric pressure. By contrast, the term 'positive pressure' refers to an absolute value of a pressure that exceeds atmospheric pressure. In the technique taught in the present specification, a simple configuration is utilized to suppress the formation of a large negative pressure within the main tank.

One technique taught in the present specification is a liquid discharge device. This liquid discharge device may comprise a discharge head, a sub tank, and a liquid replenishment device. The liquid replenishment device comprises a joint member to be connected to a main tank. The joint member is capable of being connected to and disconnected from the sub tank. The liquid within the main tank is supplied to the sub tank when the joint member is in a connected state with the sub tank. The joint member comprises a liquid path and a valve biased in a direction where the liquid path is closed. The joint member is configured to receive a force from the sub tank and open the liquid path in a case where the joint member is to be connected to the sub tank. Further, the joint member is configured to open the liquid path in a case where an inner space of the main tank has a negative pressure greater than a first value. With this configuration, the valve of the joint member for opening and closing the liquid path also functions as a valve for controlling negative pressure within the main tank. It is consequently not necessary to provide the main tank with a negative pressure controlling valve. It is thus possible to suppress the formation of a large negative pressure within the main tank utilizing a simple configuration.

DETAILED DESCRIPTION OF THE PREFERRED EMBODIMENTS (First Embodiment)

Figure 1:
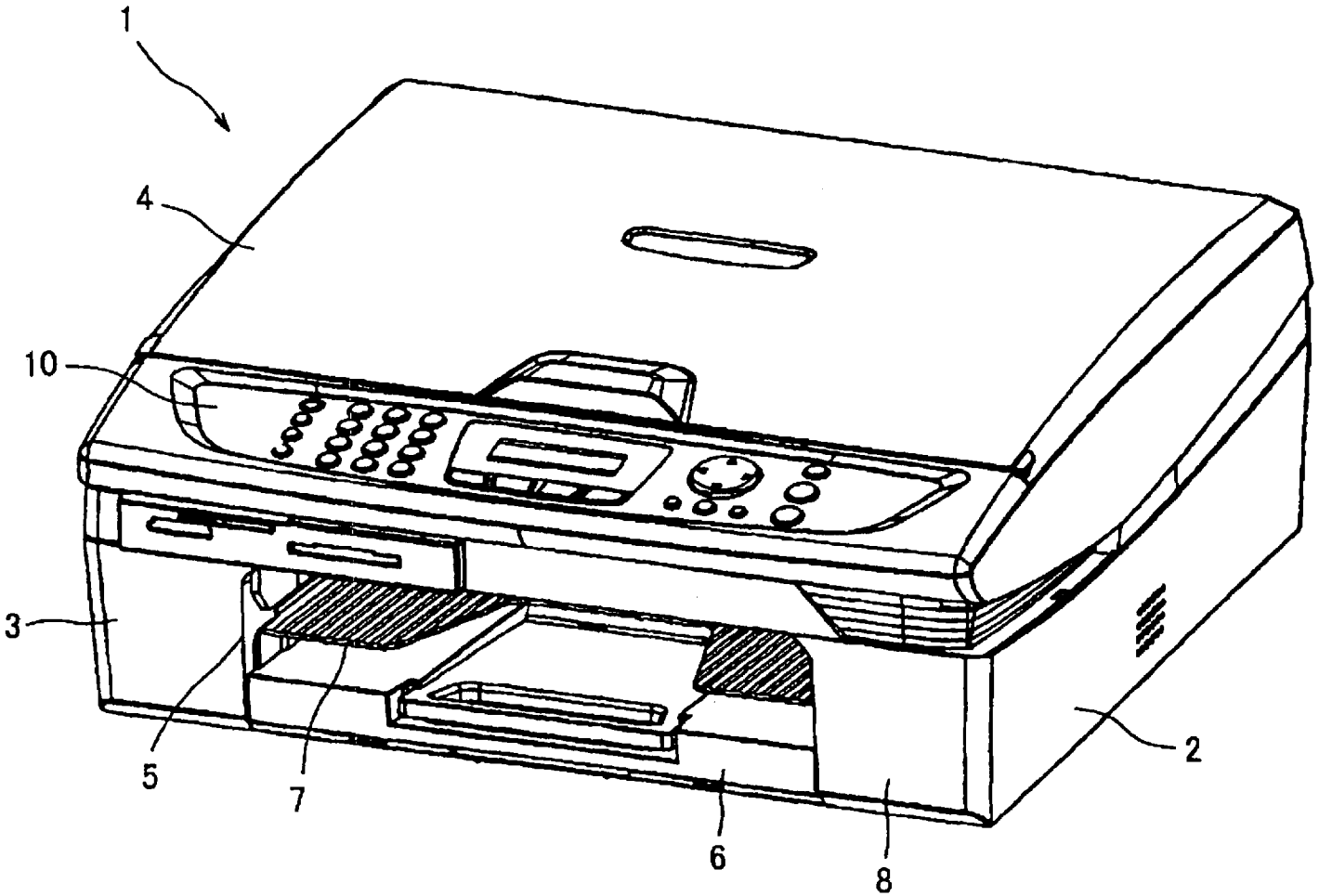
FIG. 1 shows a perspective view of a multi function device provided with an ink jet recording device.

FIG. 1 shows a perspective view of a multi function device 1 provided with an ink jet recording device 3. The multi function device 1 has a printer function, scanner function, copy function, and facsimile function. The multi function device 1 has a casing 2, the ink jet recording device 3 disposed within a lower part of the casing 2, and a scanner device 4 disposed within an upper part of the casing 2. An opening 5 is formed in a front surface of the casing 2. A paper supply tray 6 of the ink jet recording device 3 is disposed in a lower part of the opening 5. A paper discharge tray 7 of the ink jet recording device 3 is disposed in an upper part of the opening 5. An opening and closing cover 8 is formed at a lower right side of a front surface side of the ink jet recording device 3. A main tank mounting part 9 (see FIG. 3) is formed at an inner side of the opening and closing cover 8. An operation panel 10 for operating the ink jet recording device 3, the scanner device 4, etc. is formed at an upper part of a front surface side of the multi function device 1. Further, in the case where an external computer is connected, the multi function device 1 is capable of operating on the basis of commands transmitted from the computer via a driver.

Figure 2:
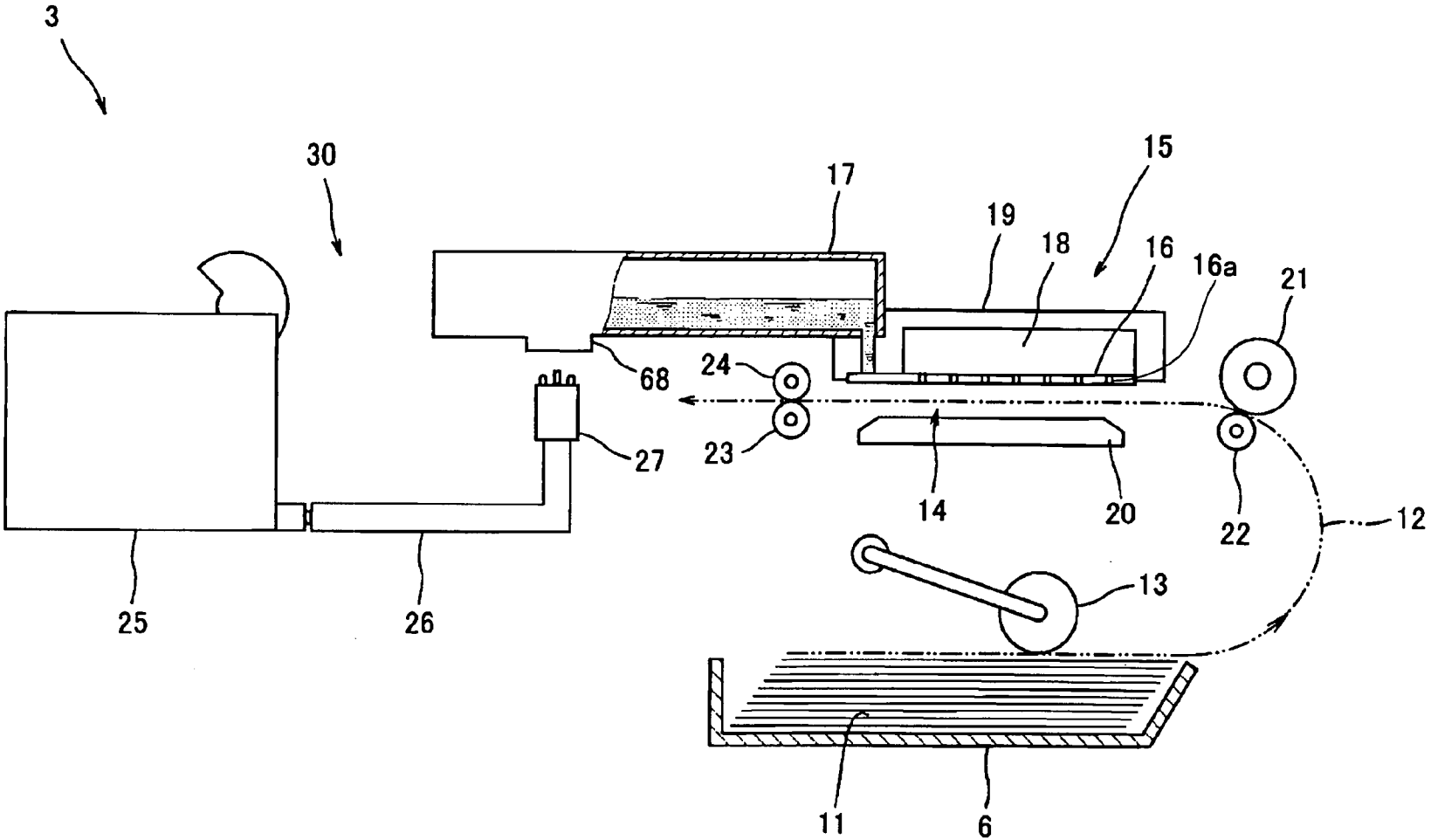
FIG. 2 shows a schematic cross-sectional view of the ink jet recording device.

FIG. 2 shows a schematic cross-sectional view of the ink jet recording device 3. The paper supply tray 6 is disposed at a bottom side of the multi function device 1. A paper supply driving roller 13 is disposed at an upper side of the paper supply tray 6. The paper supply driving roller 13 supplies an uppermost sheet of paper 11 stacked in the paper supply tray 6 to a feeding path 12. The feeding path 12 extends upwards from a back surface side of the paper supply tray 6 and then forms a U-turn to face toward a front surface side thereof. The feeding path 12 passes a printing region 14 and extends to the paper discharge tray 7 (see FIG. 1).

An image recording unit 15 is disposed in the printing region 14. A platen 20 that is larger than the paper size is disposed below the image recording unit 15. A feeding roller 21 and a pinch roller 22 are disposed at an upstream side of the image recording unit 15 along a paper transportation direction. The rollers 21 and 22 feed the paper 11 toward the platen 20. A paper discharge roller 23 and a pinch roller 24 are disposed at a downstream side of the image recording unit 15 along the paper transportation direction. The rollers 23 and 24 feed the paper 11 that has had an image printed thereon toward the paper discharge tray 7 (see FIG. 1).

The image recording unit 15 comprises a discharge head 16, a sub tank 17, a head controlling substrate 18, and a carriage 19. The discharge head 16 has a plurality of nozzle holes 16*a*. The discharge head 16 discharges ink towards the platen 20 from the nozzle holes 16*a*. The discharge head 16 may be a commonly known piezoelectric driven type. The sub tank 17 stores ink to be supplied to the discharge head 16. The head controlling substrate 18 controls the operation of the discharge head 16. The discharge head 16, sub tank 17, and head controlling substrate 18 are mounted on the carriage 19.

The sub tank 17 has a first joint part 68. The ink jet recording device 3 is provided with an ink replenishment mechanism 30. The first joint part 68 can be connected with the ink replenishment mechanism 30. Ink can be replenished into the sub tank 17 when the first joint part 68 and the ink replenishment mechanism 30 are in a connected state. The ink replenishment mechanism 30 is provided with a main tank 25, an ink supply tube 26, and a second joint part 27. The main tank 25 is housed detachably in the main tank mounting part 9 shown in FIG. 3. The main tank 25 is a cartridge type. One end of the ink supply tube 26 is connected with the main tank 25. The other end of the ink supply tube 26 is connected with the second joint part 27. The second joint part 27 is capable of moving in a vertical direction. The second joint part 27 is thus attached to and detached from the first joint part 68 of the sub tank 17. The second joint part 27 is connected to the first joint part 68 when the second joint part 27 is raised. In this state, the main tank 25 communicates with the sub tank 17 via the ink supply tube 26. That is, an ink replenishment path 26, 27*a*, 72 is in a connected state.

Figure 3:
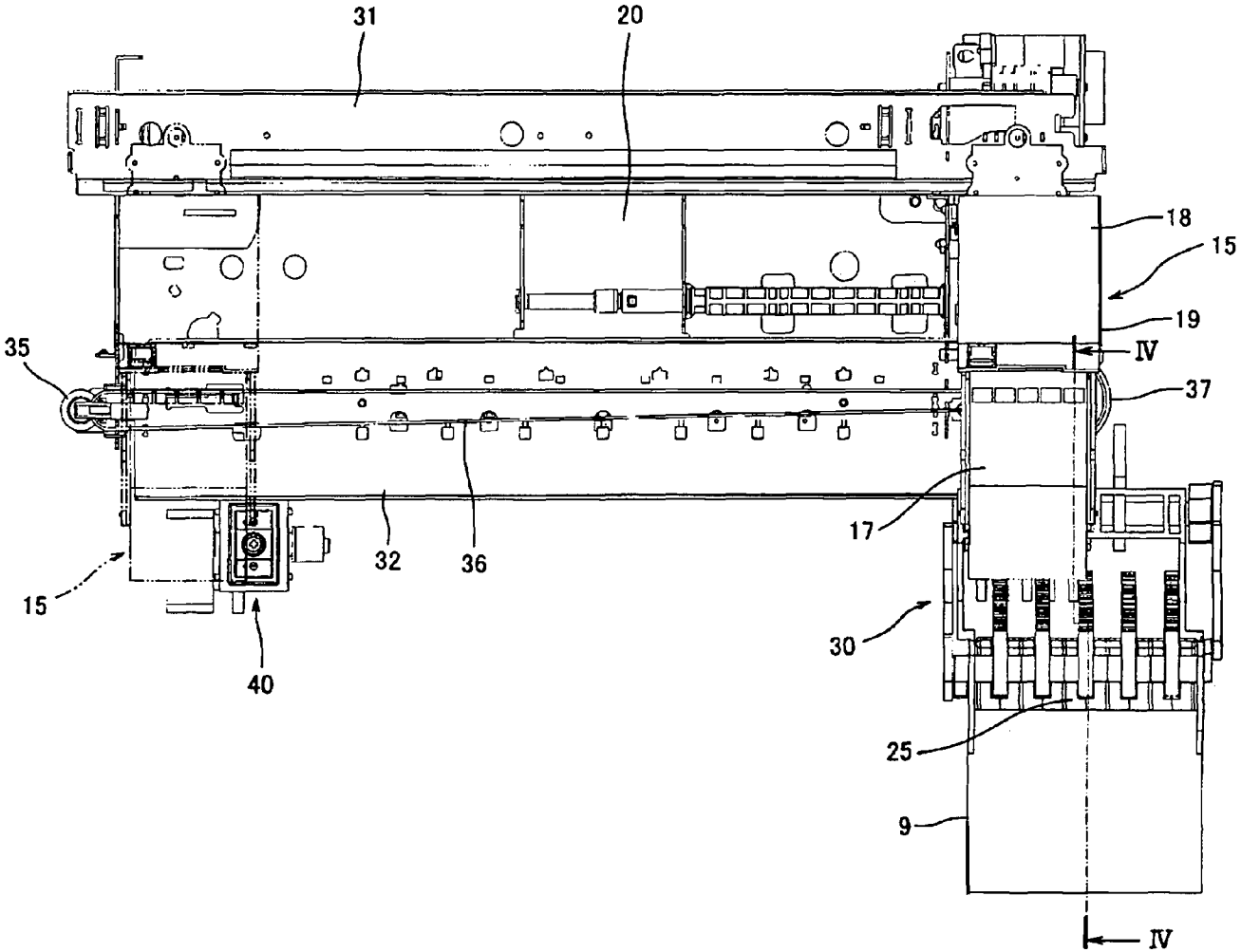
FIG. 3 shows a plan view of the ink jet recording device.

FIG. 3 shows a plan view of the ink jet recording device 3. A pair of guide rails 31 and 32 is disposed above the platen 20. The guide rails 31 and 32 have a flat plate shape. The guide rails 31 and 32 extend along a scanning direction that is orthogonal to a paper feeding direction (the up-down direction in FIG. 3). The guide rails 31 and 32 are formed on substantially the same plane. Upper surfaces of the guide rails 31 and 32 are substantially parallel to an upper surface of the platen 20, and are formed so as to be horizontal. The guide rails 31 and 32 support the carriage 19 of the image recording unit 15. The carriage 19 is capable of sliding in the direction in which the guide rails 31 and 32 extend (the left-right direction in FIG. 3).

A driving pulley (not shown) and a driven pulley 35 are disposed at the upper surface of the guide rail 32 that is located at the downstream side in the paper transportation direction. The driving pulley is disposed at one end part in the scanning direction. The driven pulley 35 is disposed at the other end part in the scanning direction. A ring shaped timing belt 36 is hung between the driving pulley and the driven pulley 35. A bottom part of the carriage 19 is fixed to a part of the timing belt 36. A motor 37 is connected to an axis of the driving pulley. The motor 37 causes the driving pulley to rotate. The timing belt 36 consequently rotates between the driving pulley and the driven pulley 35. When the timing belt 36 rotates, the carriage 19 moves along the guide rails 31 and 32. The carriage 19 can be made to move back and forth along the guide rails 31 and 32 by changing the direction of rotation of the motor 37. When the carriage 19 moves, the members mounted therein (the discharge head 16, the sub tank 17, and the head controlling substrate 18) move integrally with the carriage 19. The sub tank 17 has five ink storage chambers that correspond to the five colors of ink used in printing. Further, each of the ink storage chambers has a capacity capable of storing a greater amount of ink than that estimated to be consumed in one printing process.

The ink replenishment mechanism 30 and a maintenance mechanism 40 are disposed at an outer side of the printing region which the paper passes. The ink replenishment mechanism 30 is disposed at one end side in the scanning direction of the carriage 19 (the right side in FIG. 3). The ink replenishment mechanism 30 is disposed at a proximate side (the lower side in FIG. 3) of the guide rail 32. The ink replenishment mechanism 30 comprises the main tank mounting part 9. The main tank mounting part 9 is capable of housing five main tanks 25 corresponding to the five colors of ink.

Figure 4:
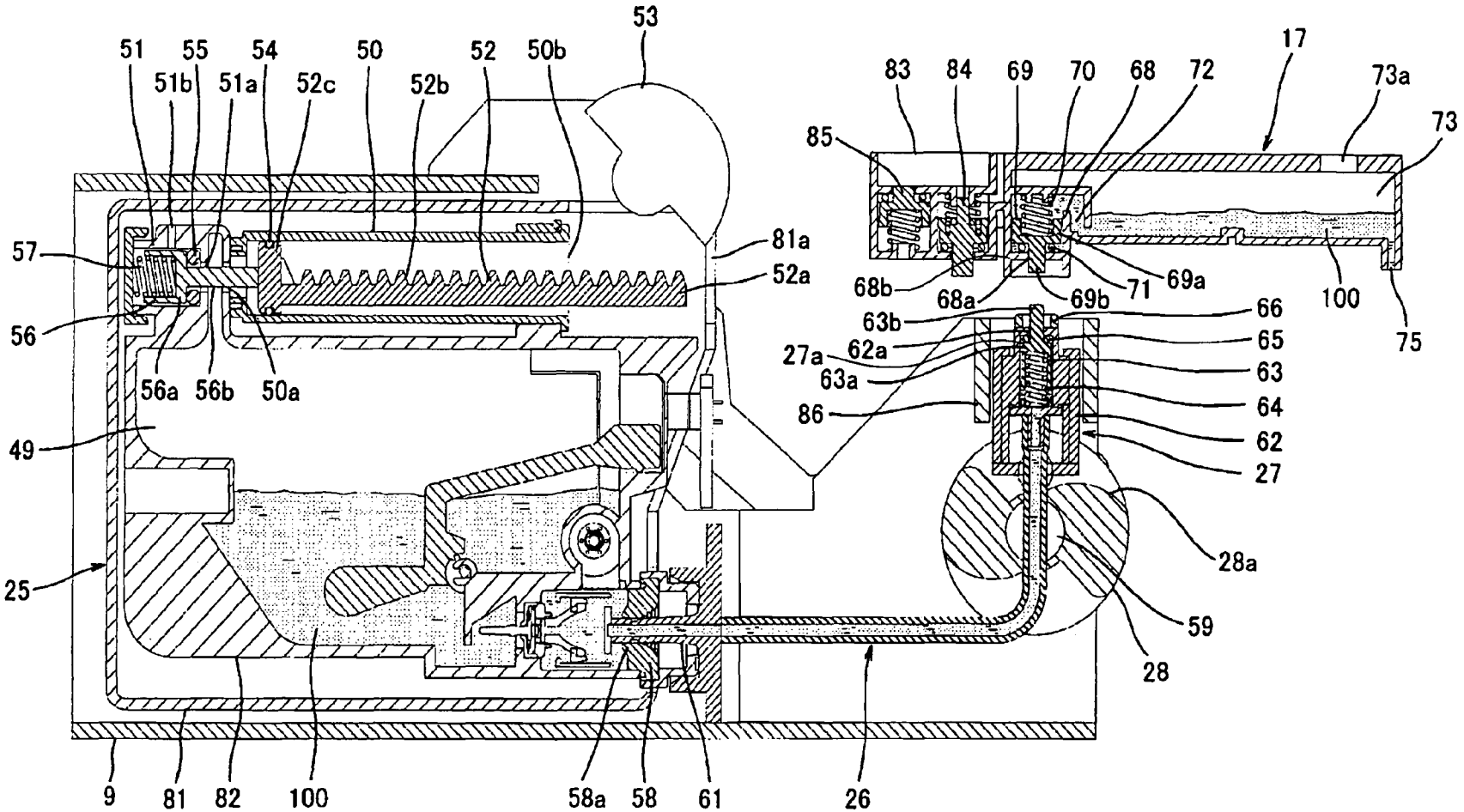
FIG. 4 shows a cross-sectional view along the line IV-IV of FIG. 3. An ink replenishment path is in a disconnected state.

FIG. 4 shows a cross-sectional view along the line IV-IV of FIG. 3. The main tank 25 has an outer case 81 and an inner case 82. The inner case 82 has an ink storage chamber 49 that stores ink 100. A piston pump chamber 50 and a positive pressure controlling chamber 51 are disposed above the ink storage chamber 49. The piston pump chamber 50 is disposed at the right side, and the positive pressure controlling chamber 51 is disposed at the left side. The piston pump chamber 50 communicates with an air layer in a top part of the ink storage chamber 49. A piston 52 is inserted into the piston pump chamber 50 in a manner capable of moving back and forth. The piston 52 comprises a rod part 52*a*, a rack gear part 52*b*, and a piston part 52*c*. The rod part 52*a* has a smaller diameter than the piston pump chamber 50. The rack gear part 52*b* is formed on an upper surface of the rod part 52*a*. The piston part 52*c* is disposed at a left end part of the rod part 52*a*. An O ring 54 is attached to the piston part 52*c*. The O ring 54 makes contact with an inner circumference surface of the piston pump chamber 50. Gas is consequently unable to pass between a right side and a left side of the O ring 54.

An insertion hole 50*a* and an opening part 50*b* are formed in the piston pump chamber 50. The insertion hole 50*a* is formed in a wall surface facing the positive pressure controlling chamber 51. The opening part 50*b* is formed in a wall surface at the other side from the insertion hole 50*a*. The opening part 50*b* allows the rod part 52*a* to pass therethrough. An opening part 81*a* is formed in the outer case 81. The opening part 81*a* is formed by making a notch in a wall surface of a sub tank side of the outer case 81. The opening part 81*a* is formed in a region corresponding to the opening part 50*b* of the piston pump chamber 50. Furthermore, a substantially half-circle shaped pinion gear 53 is disposed at an upper part of the main tank mounting part 9. The pinion gear 53 is driven to rotate by a driving means (not shown). The pinion gear 53 passes through the opening part 81*a* and meshes with the rack gear part 52*b*. That is, when the pinion gear 53 rotates, power is transmitted to the rack gear part 52*b*. The piston 52 can thus move back and forth.

A positive pressure controlling valve 56 is inserted into the positive pressure controlling chamber 51. The positive pressure controlling valve 56 is capable of moving back and forth in a left-right direction. The positive pressure controlling valve 56 comprises a base part 56*a* and a shaft part 56*b*. There is a clearance between the base part 56*a* and an inner circumference surface of the positive pressure controlling chamber 51. This clearance allows communication between the left side and the right side of the base part 56*a*. The shaft part 56*b* protrudes from the base part 56*a* toward the piston 52. A first atmosphere communication hole 51*a* is formed in the positive pressure controlling chamber 51. The first atmosphere communication hole 51*a* is formed in a wall surface facing the piston pump chamber 50. The first atmosphere communication hole 51*a* allows the shaft part 56*b* to pass therethrough. There is a clearance, in the first atmosphere communication hole 51*a*, between the shaft part 56*b* and the positive pressure controlling chamber 51. Further, the shaft part 56*b* passes through the insertion hole 50*a*. There is a clearance, in the insertion hole 50*a*, between the shaft part 56*b* and the piston pump chamber 50. A sealing ring 55 is attached to an inner surface of the positive pressure controlling chamber 51. The sealing ring 55 is disposed between the base part 56*a* and the wall facing the piston pump chamber 50. A coiled spring 57 makes contact with the base part 56*a* of the positive pressure controlling valve 56. The coiled spring 57 biases the base part 56*a* toward the sealing ring 55. Further, a second atmosphere communication hole 51*b* is formed in the positive pressure controlling chamber 51. The second atmosphere communication hole 51*b* is formed in an upper wall surface of the positive pressure controlling chamber 51. The sealing ring 55 is present between the first atmosphere communication hole 51*a* and the second atmosphere communication hole 51*b*. In a normal state there is no communication between the first atmosphere communication hole 51*a* and the second atmosphere communication hole 51*b* because the sealing ring 55 creates a seal between the base part 56*a* and the inner circumference surface of the positive pressure controlling chamber 51.

In the case where positive pressure equal to or above a predetermined value is formed in the ink storage chamber 49, the positive pressure controlling valve 56 separates from the sealing ring 55 against the biasing force of the coiled spring 57. The first atmosphere communication hole 51*a* and the second atmosphere communication hole 51*b* thus communicate. In this case, the ink storage chamber 49 communicates with the atmosphere via the first atmosphere communication hole 51*a* and the second atmosphere communication hole 51*b*. Further, the positive pressure controlling valve 56 separates from the sealing ring 55 against the biasing force of the coiled spring 57 even in the case where the piston 52 moves toward the positive pressure controlling chamber 51 and presses the shaft part 56*b*. In this case, as well, the first atmosphere communication hole 51*a* and the second atmosphere communication hole 51*b* communicate, and the ink storage chamber 49 communicates with the atmosphere. The spring constant of the coiled spring 57 is set such that positive pressure that is transmitted from the main tank 25 to the nozzle hole 16*a* of the discharge head 16 (see FIG. 2) when a second joint part 27 (to be described) is connected to the sub tank 17 does not exceed a meniscus pressure (a pressure destroying the meniscus of the nozzle hole 16*a*) of the nozzle hole 16*a*. Moreover, the main tank 25 is not provided with a negative pressure controlling valve for releasing the ink storage chamber 49 to the atmosphere in the case where negative pressure equal to or exceeding a predetermined value has been formed in the ink storage chamber 49.

A tube connecting part 58 capable of deforming elastically is disposed at a lower part of the main tank 25. The tube connecting part 58 has a ring shape. An ink hole 58*a* is formed in a center of the tube connecting part 58. The tube connecting part 58 contracts due to resilient force when there is no load, thus closing the ink hole 58*a*. A connecting terminal 61 is connected to one end part of the ink supply tube 26. The connecting terminal 61 is inserted into the tube connecting part 58. The ink supply tube 26 thus communicates with the ink storage chamber 49 of the main tank 25. The second joint part 27 is connected to the other end part of the ink supply tube 26.

The second joint part 27 has a casing 62 that communicates with the ink supply tube 26. An outlet hole 62*a* is formed in an upper wall of the casing 62. The outlet hole 62*a* is located in a position higher than an ink level within the main tank 25 even in the case where the second joint part 27 is located in its lowermost position. The positional relationship of the joint part 27 and the main tank mounting part 9 (the main tank 25) is adjusted such that the above positional relationship is achieved. A guiding cylindrical part 86 is formed integrally with the main tank mounting part 9. The casing 62 is capable of sliding in the vertical direction (up-down direction in FIG. 4) along an inner circumference surface of the guiding cylindrical part 86. A ring shaped sealing member 66 capable of deforming elastically is attached to an upper end surface of the casing 62. The sealing member 66 is disposed at the surroundings of the outlet hole 62*a*. A cam roller 28 is disposed below the casing 62. The cam roller 28 is connected to a driving shaft 59. The driving shaft 59 is connected with a driving source (not shown). When the driving shaft 59 rotates, the cam roller 28 rotates in a clockwise or anti-clockwise direction. The cam roller 28 has a cam surface 28*a*. The cam surface 28*a* smoothly changes the distance in a radial direction to the driving shaft 59. When the cam roller 28 rotates in an anti-clockwise direction from the state shown in FIG. 4, the cam surface 28*a* makes contact with a lower surface of the casing 62, and raises the second joint part 27. When the cam roller 28 rotates in a clockwise direction from the state where the second joint part 27 is in the raised position, the second joint part 27 descends along the cam surface 28*a*.

A second opening and closing valve 63 is inserted into the casing 62 in a manner capable of moving in the vertical direction. The second opening and closing valve 63 has a base part 63*a* and a shaft part 63*b*. There is a clearance between the base part 63*a* and an inner circumference surface of the casing 62. This clearance allows communication between an upper side and a lower side of the base part 63*a*. The shaft part 63*b* protrudes upward from the base part 63*a*. The shaft part 63*b* passes through the outlet hole 62*a*. There is a clearance, in the outlet hole 62*a*, between the shaft part 63*b* and the inner circumference surface of the casing 62. This clearance allows communication between an upper side and a lower side of the outlet hole 62*a*. A sealing ring 65 is attached to the inner circumference surface of the casing 62. The sealing ring 65 is disposed at the surroundings of the outlet hole 62*a*. The sealing ring 65 is disposed between the casing 62 and the base part 63*a* of the second opening and closing valve 63. A coiled spring 64 makes contact with the base part 63*a* of the second opening and closing valve 63. The coiled spring 64 biases the base part 63*a* toward the sealing ring 65. In a normal state (a state where the second joint part 27 is not making contact with the sub tank 17), the base part 63*a* makes contact with the sealing ring 65. An ink path 27*a* within the second joint part 27 is thus closed by the second opening and closing valve 63 because the sealing ring 65 creates a seal between the base part 63*a* and the inner circumference surface of the casing 62. The ink path 27*a* is formed in spaces between the casing 62 and the second opening and closing valve 63 (a space of the outlet hole 62*a*, a space between the sealing ring 65 and the second opening and closing valve 63, etc.). Moreover, when the base part 63*a* is making contact with the sealing ring 65, the shaft part 63*b* protrudes upward beyond the sealing member 66.

In the case where the shaft part 63*b* of the second opening and closing valve 63 has been pushed back by resistance from a first opening and closing valve 69 (to be described), the second opening and closing valve 63 separates from the sealing ring 65 against the biasing force of the coiled spring 64. In this case, the ink path 27*a* within the second joint part 27 is opened. Further, the second opening and closing valve 63 separates from the sealing ring 65 against the biasing force of the coiled spring 64 even in the case where negative pressure equal to or exceeding a predetermined value has been formed in the ink path 27*a* due to negative pressure formed in the ink storage chamber 49 or the ink supply tube 26. In this case, as well, the ink path 27*a* within the second joint part 27 is opened. Moreover, the spring constant of the coiled spring 64 is set such that negative pressure that is transmitted from the main tank 25 to the nozzle hole 16*a* of the discharge head 16 (see FIG. 2) when the second joint part 27 is connected to the sub tank 17 does not exceed a meniscus pressure (a pressure destroying the meniscus of the nozzle hole 16*a*) of the nozzle hole 16*a*.

The sub tank 17 comprises the first joint part 68, an ink storage chamber 73, etc. In the case where the multi function device 1 is viewed from a plan view, the first joint part 68 is disposed in a position that corresponds to (partially overlap with) the second joint part 27. The first joint part 68 has a case part 68*b* that is formed integrally with an outer wall of the sub tank 17. An ink path 72 is formed within the case part 68*b*. The ink path 72 communicates with the ink storage chamber 73. An outlet hole 75 is formed in a lower wall of the sub tank 17. Ink 100 within the ink storage chamber 73 is supplied from the outlet hole 75 to the discharge head 16 (see FIG. 2). A communication hole 73*a* is formed in an upper wall of the ink storage chamber 73. The sub tank 17 has a pressure buffering chamber 83. The pressure buffering chamber 83 is disposed at a left side of the first joint part 68. A resin film (not shown) is applied to an upper surface of the pressure buffering chamber 83 and the ink storage chamber 73. The pressure buffering chamber 83 and the ink storage chamber 73 thus maintain an airtight state. The pressure buffering chamber 83 communicates with the ink storage chamber 73 via a gas path (not shown) that reaches the communication hole 73*a*. The pressure buffering chamber 83 has a negative pressure controlling valve 84 and a positive pressure controlling valve 85. In the case where negative pressure equal to or above a predetermined value has occurred in the pressure buffering chamber 83, the negative pressure controlling valve 84 causes the pressure buffering chamber 83 to communicate with the atmosphere. In the case where positive pressure equal to or above a predetermined value has occurred in the pressure buffering chamber 83, the positive pressure controlling valve 85 causes the pressure buffering chamber 83 to communicate with the atmosphere.

An inlet hole 68*a* is formed in a lower wall of the case part 68*b*. Further, the first joint part 68 comprises the first opening and closing valve 69. The first opening and closing valve 69 is inserted into the case part 68*b*. The first opening and closing valve 69 is capable of moving in the vertical direction along the case part 68*b*. The first opening and closing valve 69 has a base part 69*a* and a shaft part 69*b*. There is a clearance between the base part 69*a* and an inner circumference surface of the case part 68*b*. This clearance allows communication between an upper side and a lower side of the base part 69*a*. Further, the shaft part 69*b* protrudes downward from the base part 69*a*. In the inlet hole 68*a*, there is a clearance between the shaft part 69*b* and the inner circumference surface of the case part 68*b*. This clearance allows communication between an upper side and a lower side of the inlet hole 68*a*.

The shaft part 69*b* of the first opening and closing valve 69 and the shaft part 63*b* of the second opening and closing valve 63 are present on the same axis. The shaft part 69*b* and the shaft part 63*b* face one another. A sealing ring 71 is attached to the inner circumference surface of the case part 68*b*. The sealing ring 71 is disposed at the surroundings of the inlet hole 68*a*. The sealing ring 71 is disposed between the case part 68*b* and the base part 69*a* of the first opening and closing valve 69. A coiled spring 70 makes contact with the base part 69*a* of the first opening and closing valve 69. The coiled spring 70 biases the base part 69*a* toward the sealing ring 71. That is, the first opening and closing valve 69 and the second opening and closing valve 63 are biased by the coiled springs 64 and 70 in a direction of approaching one another. In the normal state (the state where the second joint part 27 is not making contact with the sub tank 17), the base part 69*a* makes contact with the sealing ring 71. The ink path 72 within the first joint part 68 is thus closed by the first opening and closing valve 69 because the sealing ring 71 creates a seal between the base part 69*a* and the inner circumference surface of the case part 68*b*. The ink path 72 is formed in spaces between the case part 68*b* and the first opening and closing valve 69 (a space of the inlet hole 68*a*, a space between the sealing ring 71 and the first opening and closing valve 69, etc.). Moreover, the spring constant of the coiled spring 70 of the first joint part 68 is substantially the same as the spring constant of the coiled spring 64 of the second joint part 27. As a result, when the shaft parts 63*b* and 69*b* strike against one another, both the ink path 27*a* and the ink path 72 are opened.

Figure 5:
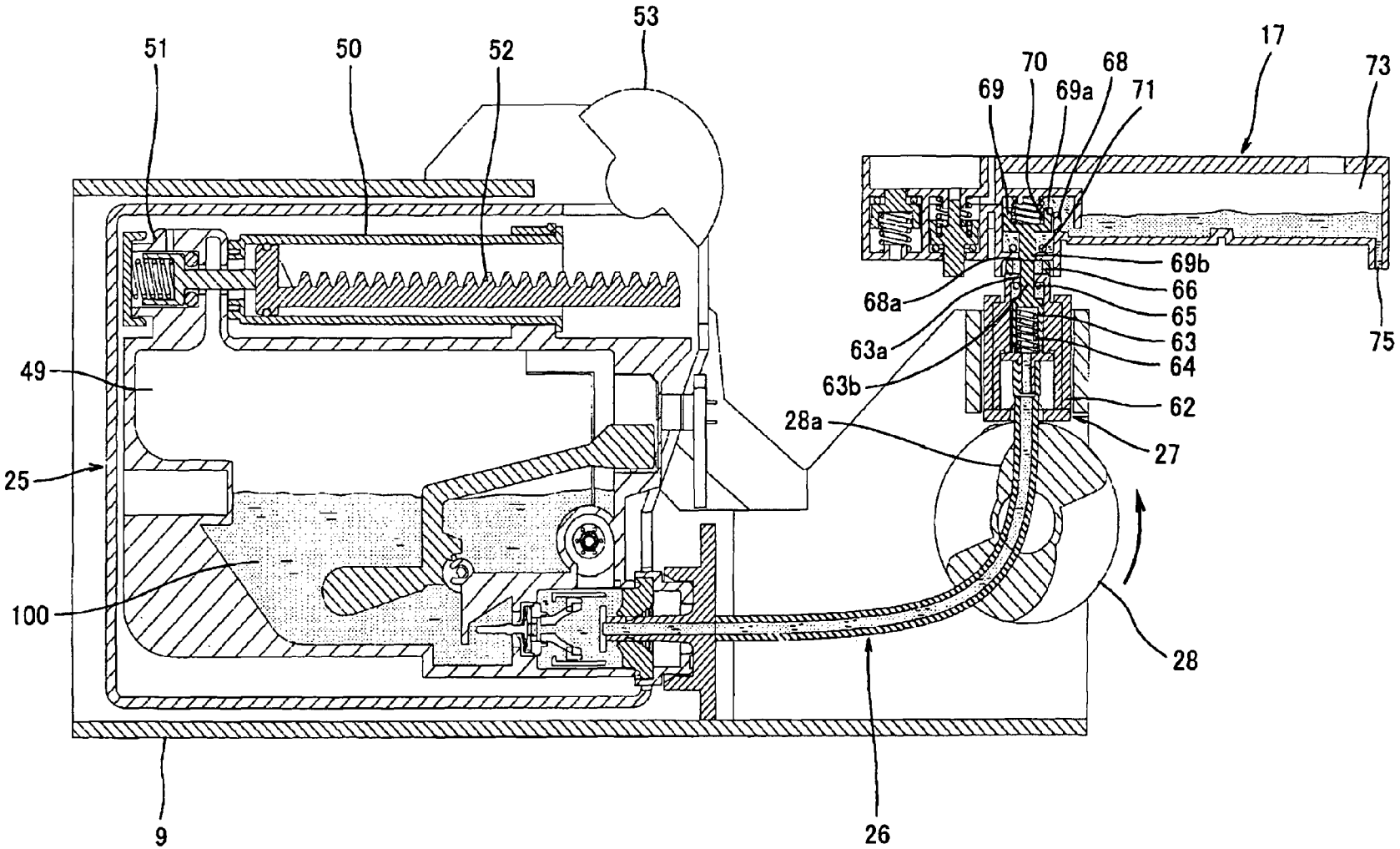
FIG. 5 shows a cross-sectional view of the ink jet recording device. The ink replenishment path is in a connected state.

Next, an ink replenishment operation will be described. FIG. 5 shows the first joint part 68 and the second joint part 27 in a connected state. FIG. 5 corresponds to the same cross-section as in FIG. 4. When the cam roller 28 is rotated in the anti-clockwise direction from the state in FIG. 4, the second joint part 27 is raised. The sealing member 66 makes contact with the surroundings of the inlet hole 68*a* in a lower surface of the first joint part 68. Further, the shaft part 63*b* of the second opening and closing valve 63 strikes against the shaft part 69*b* of the first opening and closing valve 69. The ink path 27*a* of the second joint part 27 and the ink path 72 of the first joint part 68 are thus opened.

That is, the base part 63*a* of the second opening and closing valve 63 separates from the sealing ring 65 against the biasing force of the coiled spring 64, and the base part 69*a* of the first opening and closing valve 69 separates from the sealing ring 71 against the biasing force of the coiled spring 70. The main tank 25 and the sub tank 17 thus communicate, and the ink replenishment path 26, 27*a*, 72 is in the connected state. The coiled springs 57 and 64 that respectively bias the positive pressure controlling valve 56 of the main tank 25 and the second opening and closing valve 63 of the second joint part 27 both have a spring constant set such that the pressure of an inner space within the main tank 25 and the ink supply tube 26 is maintained within a predetermined range. As a result, pressure that is transmitted from the main tank 25 via the sub tank 17 to the discharge head 16 (see FIG. 2) when the first joint part 68 and the second joint part 27 are connected does not destroy the meniscus of the nozzle hole 16*a* of the discharge head 16.

Figure 6:
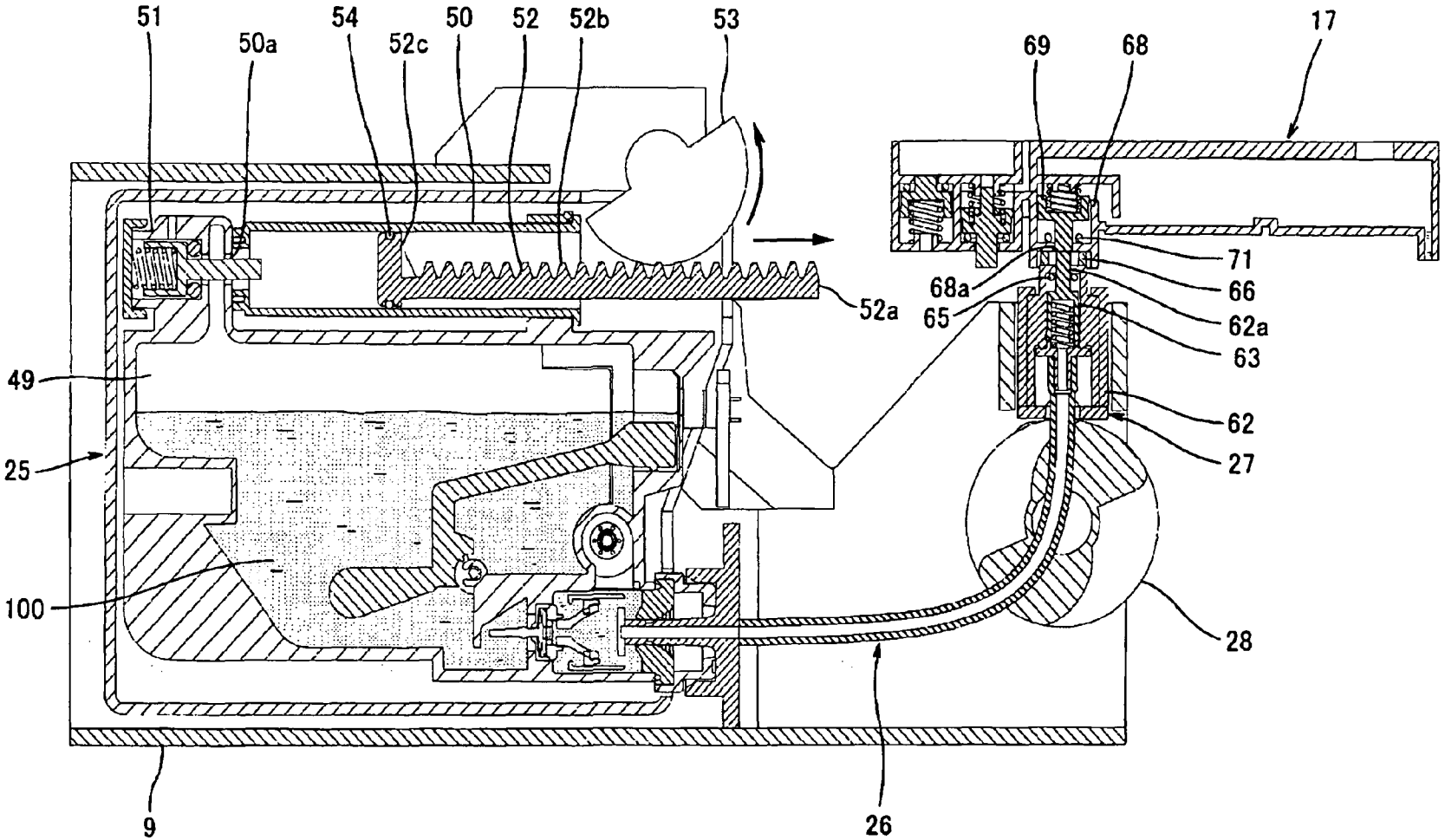
FIG. 6 shows a cross-sectional view of the ink jet recording device. The figure shows how ink returns from a sub tank to a main tank.

FIG. 6 is a figure for describing how ink returns from the sub tank 17 to the main tank 25. FIG. 6 corresponds to the same cross-section as FIG. 4. A driving source (not shown) causes the pinion gear 53 of the main tank 25 to rotate in an anti-clockwise direction. The piston 52 is thus moved away from the insertion hole 50*a*. Negative pressure is formed in the ink storage chamber 49 of the main tank 25. The ink within the sub tank 17 is sucked by this negative pressure into the main tank 25 via the ink supply tube 26.

Figure 7:
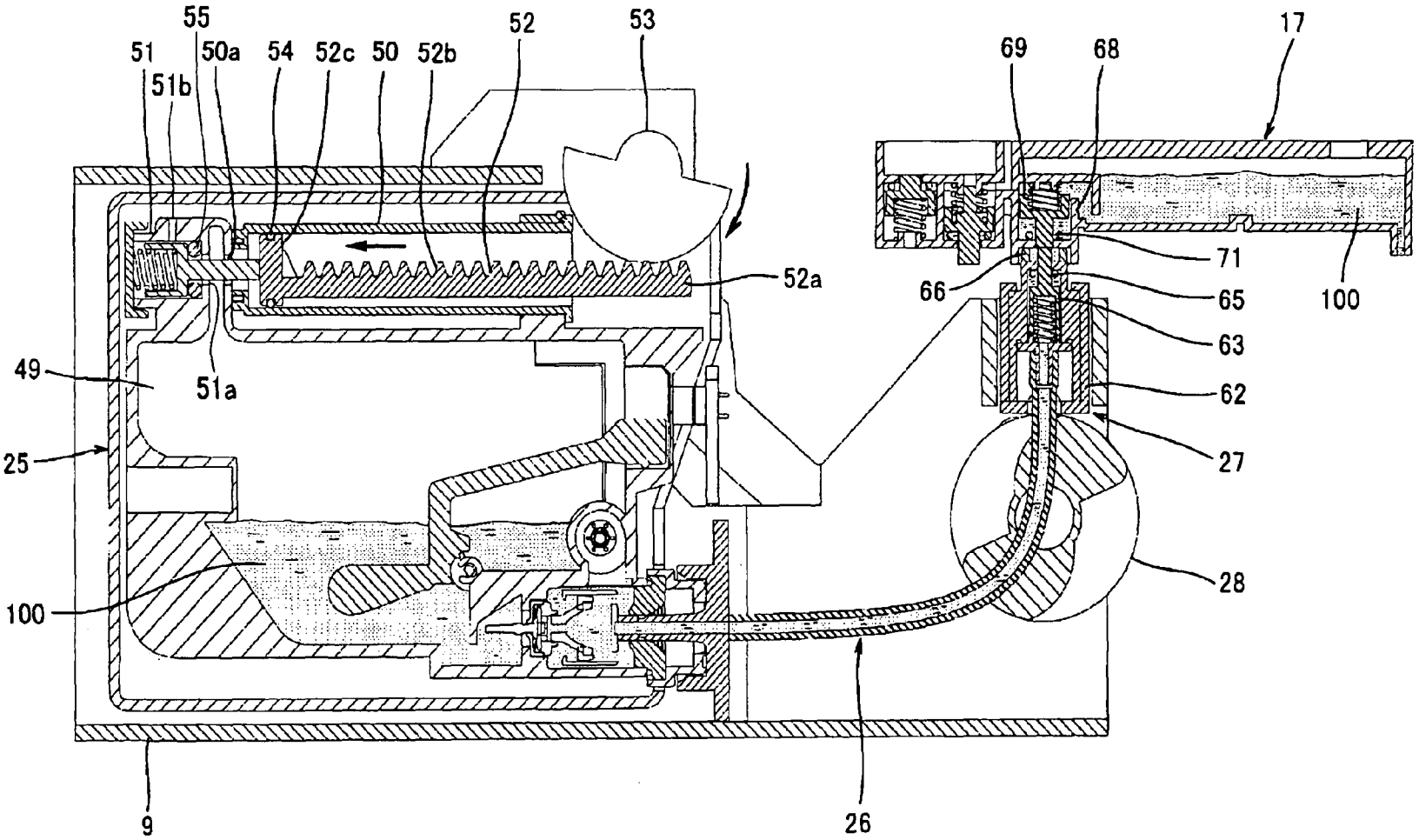
FIG. 7 shows a cross-sectional view of the ink jet recording device. The figure shows how ink is replenished from the main tank to the sub tank.

FIG. 7 is a figure for describing how ink is replenished from the main tank 25 to the sub tank 17. FIG. 7 corresponds to the same cross-section as FIG. 4. When the pinion gear 53 of the main tank 25 rotates in a clockwise direction, the piston 52 moves towards the insertion hole 50*a*. Positive pressure is formed in the ink storage chamber 49 of the main tank 25. The ink within the ink storage chamber 49 of the main tank 25 is supplied by this positive pressure to the sub tank 17 via the ink supply tube 26. The amount of ink replenished into the sub tank 17 at this juncture is set to be an amount of ink equal to or greater than the amount estimated to be consumed in the next printing operation. The piston 52 is not at a leftmost position in the state shown in FIG. 7. In this state, the sealing ring 55 is functioning, and the first atmosphere communication hole 51*a* and the second atmosphere communication hole 51*b* are not communicating.

Figure 8:
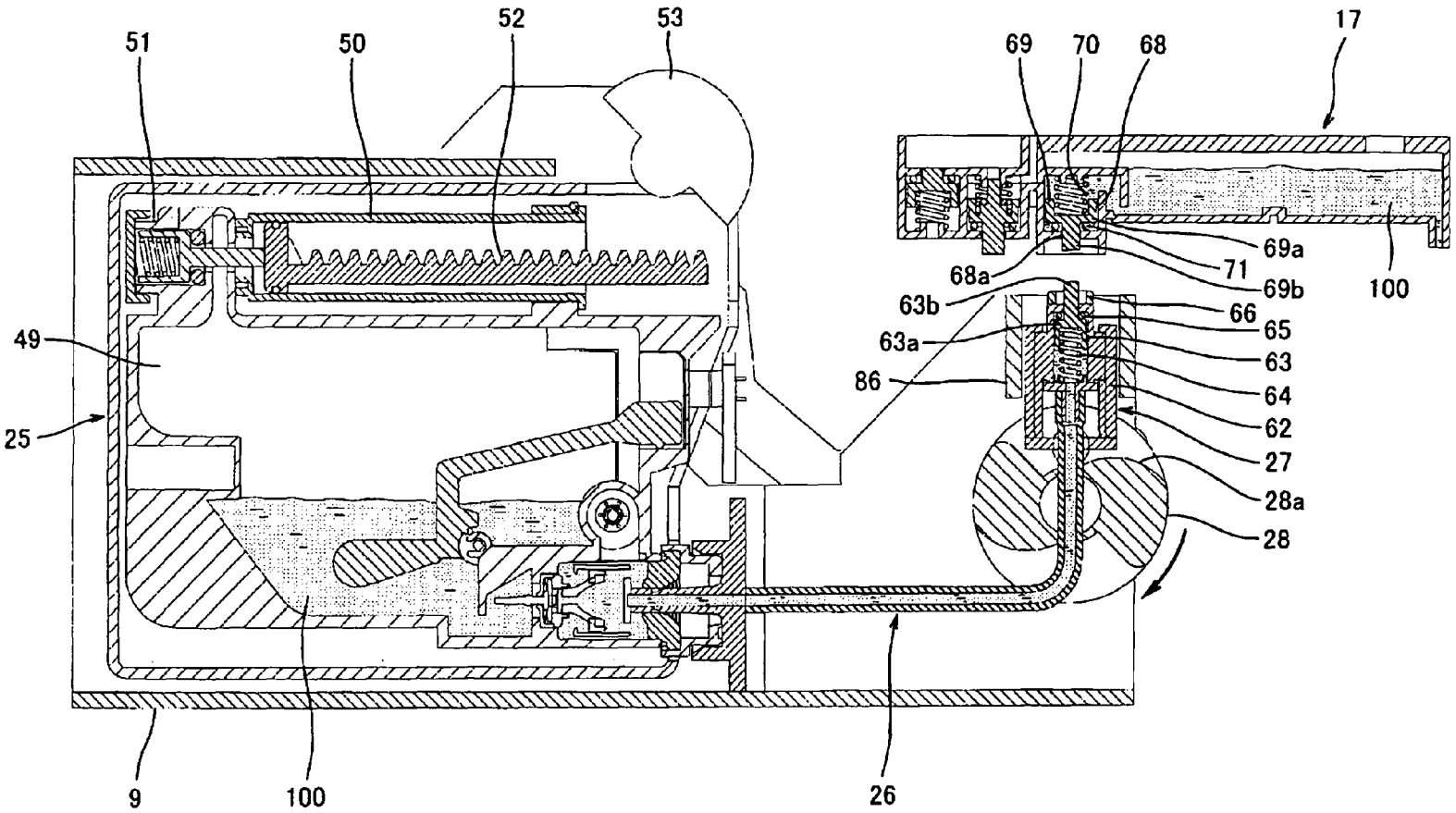
FIG. 8 shows a cross-sectional view of the ink jet recording device. The figure shows how a joint part is disconnected from the sub tank.

FIG. 8 shows a state in which the ink replenishment operation of the sub tank 17 has been completed. FIG. 8 corresponds to the same cross-section as FIG. 4. When the ink replenishment operation of the sub tank 17 has been completed, the cam roller 28 rotates in the clockwise direction, and the second joint part 27 is lowered. The lower surface of the first joint part 68 and the sealing member 66 of the second joint part 27 thus separate, and the shaft part 63*b* of the second opening and closing valve 63 and the shaft part 69*b* of the first opening and closing valve 69 thus separate. The base part 69*a* of the first opening and closing valve 69 fits with the sealing ring 71 due to the biasing force of the coiled spring 70, and the first opening and closing valve 69 is closed. That is, the ink path 72 of the first joint part 68 is closed. Further, the base part 63*a* of the second opening and closing valve 63 fits with the sealing ring 65 due to the biasing force of the coiled spring 64, and the second opening and closing valve 63 is closed. That is, the ink path 27*a* of the second joint part 27 is closed.

With the configuration of the present embodiment, the second opening and closing valve 63 of the second joint part 27 for connecting and disconnecting the main tank 25 and the sub tank 17 also functions as a negative pressure controlling valve. It is consequently not necessary to provide the main tank 25 with a negative pressure controlling valve, and only the positive pressure controlling valve 56 needs to be provided. A space for providing the negative pressure controlling valve no longer needs to be provided in the main tank 25, and consequently space efficiency can be improved. Further, the number of components and cost can be reduced.

In the present embodiment, the second opening and closing valve 63 of the second joint part 27 also functions as a negative pressure controlling valve. In order for the second opening and closing valve 63 to function effectively as the negative pressure controlling valve, the spring constant of the coiled spring 64 cannot be too large. This is because, if the spring constant of the coiled spring 64 is large, the second opening and closing valve 63 cannot open even if a negative pressure has been formed. The spring constant of the coiled spring 64 is not particularly large in the present embodiment. It could be said that the second opening and closing valve 63 is comparatively easy to open. It is necessary to prevent ink from leaking from the second joint part 27 since the second opening and closing valve 63 opens easily. For this purpose, the ink path 27*a* of the second joint part 27 opens upward in the present embodiment (it can also be said that the outlet hole 62*a* opens upward). It is thus possible to prevent ink from leaking from the second joint part 27 although the second opening and closing valve 63 opens easily. Further, in the present embodiment, the spring constant of the coiled spring 70 of the first joint part 68 is substantially the same as the spring constant of the coiled spring 64 of the second joint part 27. However, the spring constant of the coiled spring 70 may equally well be greater than the spring constant of the coiled spring 64. In this case, the seal effectiveness of the first opening and closing valve 69 can be increased.

Further, even if ink adheres to the vicinity of the outlet hole 62*a*, it is possible to prevent this ink from dripping down onto the feeding path 12 (see FIG. 2) since the ink path 27*a* of the second joint part 27 opens upward. Further, the second joint part 27 comprises the ring shaped sealing member 66 that extends upward so as to enclose the surrounding of the outlet hole 62*a*. As a result, ink leaking from the outlet hole 62*a* is contained by the sealing member 66. It is thus possible to prevent ink from dispersing into the feeding path 12 (see FIG. 2).

Further, there is a possibility that an ink film may be formed within the sealing member 66 when a ring shaped sealing member 66 is utilized. If the sealing member 66 were attached to the first joint part 68, the ink film formed within the sealing member 66 might run down when the first and the second joint parts 68 and 27 are not connected. In the present embodiment, however, the sealing member 66 is attached to the second joint part 27. It is consequently possible to prevent the ink film formed within the sealing member 66 from running down. However, this description does not necessarily forbid the sealing member 66 from being attached to the first joint part 68. The sealing member 66 may equally well be attached to the first joint part 68.

(Second Embodiment)

Figure 9:
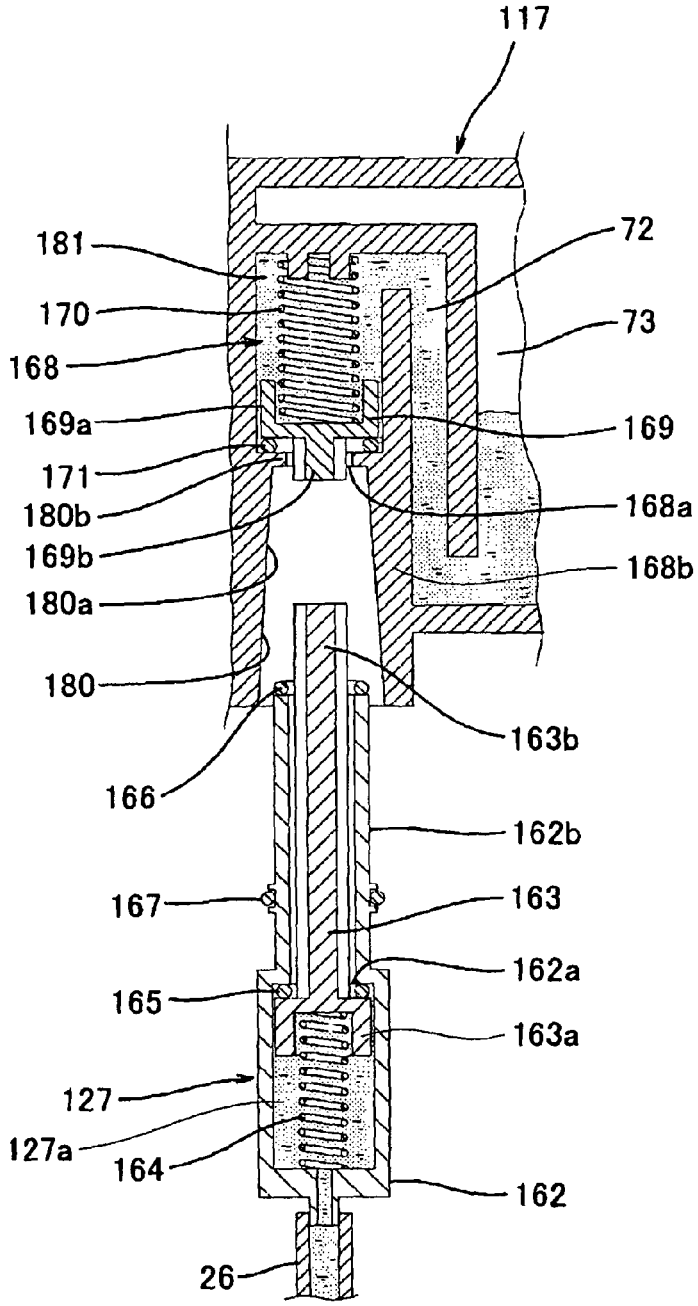
FIG. 9 shows a cross-sectional view of a first joint part and a second joint part. The first joint part and the second joint part are shown in a disconnected state.
Figure 10:
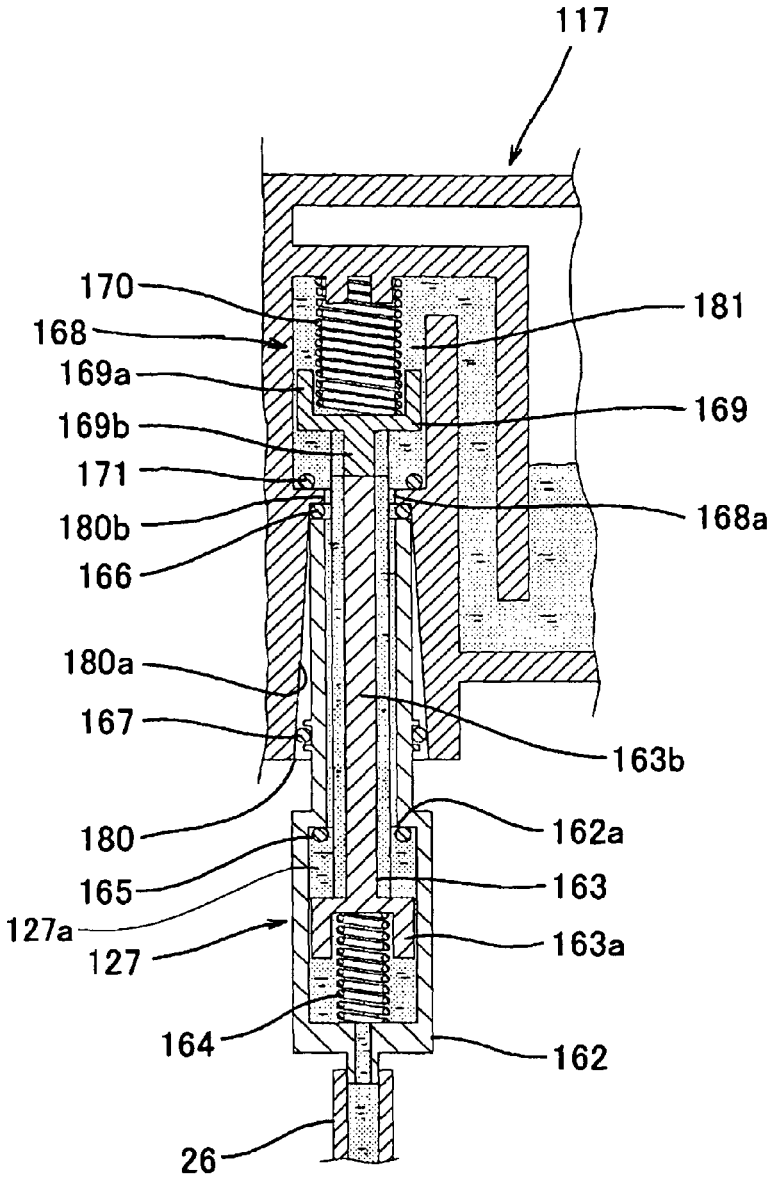
FIG. 10 shows a cross-sectional view of the first joint part and the second joint part. The first joint part and the second joint part are shown in a connected state.

FIG. 9 shows a cross-sectional view of a second joint part 127 of a second embodiment. FIG. 9 shows the second joint part 127 in a state where it is not connected with a first joint part 168. FIG. 10 shows the second joint part 127 in a state where it is connected with the first joint part 168. Moreover, the same reference numbers are applied to the component parts that have the same configuration as in the first embodiment, and a description of those component parts is omitted.

The second joint part 127 comprises a casing 162. A lower end of the casing 162 communicates with the ink supply tube 26. An outlet hole 162*a* is formed in an upper wall of the casing 162. An ink path 127*a* is formed within the casing 162. Further, a ring shaped member 162*b* is present that extends upward from an upper surface of the casing 162. The member 162*b* is formed integrally with the casing 162. The member 162*b* extends upward from the surroundings of the outlet hole 162*a*. A first sealing member 166 is attached to an upper end part of the member 162*b*. A second sealing member 167 is attached to a side surface of the member 162*b*. The second sealing member 167 is disposed below the center of the member 162*b* in the direction of height thereof.

A second opening and closing valve 163 is inserted into the casing 162 in a manner capable of moving in an up-down direction. The second opening and closing valve 163 has a base part 163*a* and a shaft part 163*b*. There is a clearance between the base part 163*a* and an inner circumference surface of the casing 162. This clearance allows communication between an upper side and a lower side of the base part 163*a*. Further, the shaft part 163*b* protrudes upward from the base part 163*a*. There is a clearance, in the outlet hole 162*a*, between the shaft part 163*b* and the casing 162. This clearance allows communication between an upper side and a lower side of the outlet hole 162*a*. Further, there is also a clearance between the shaft part 163*b* and the member 162*b*. The shaft part 163*b* protrudes upward beyond the member 162*b*.

A sealing ring 165 is attached to the inner circumference surface of the casing 162. The sealing ring 165 is disposed at the surroundings of the outlet hole 162*a*. The sealing ring 165 is disposed between the casing 162 and the base part 163*a* of the second opening and closing valve 163. A coiled spring 164 makes contact with the base part 163*a* of the second opening and closing valve 163. The coiled spring 164 biases the base part 163*a* toward the sealing ring 165. In a normal state (a state where the second joint part 127 is not making contact with the sub tank 117), the base part 163*a* makes contact with the sealing ring 165. The ink path 127*a* within the second joint part 127 is thus closed by the second opening and closing valve 163. Moreover, when the base part 163*a* is making contact with the sealing ring 165, the shaft part 163*b* protrudes upward beyond the first sealing member 166.

The sub tank 117 comprises the first joint part 168. The first joint part 168 is disposed in a position that corresponds to the second joint part 127. The first joint part 168 has a case part 168*b*. A concave part 180 that opens downward is formed in the case part 168*b*. The concave part 180 comprises a taper part 180*a* that grows smaller in diameter as it extends upward, and a flange part 180*b* that protrudes inward in a radial direction from an upper edge of the taper part 180*a*. A space at an inner side of the flange part 180*b* is an inlet hole 168*a*. A valve space 181 (a part of the ink path 72) is present at an upper side of the inlet hole 168*a*, and the concave part 180 is present at a lower side of the inlet hole 168*a*. The valve space 181 and the concave part 180 communicate by means of the inlet hole 168*a*.

Further, a first opening and closing valve 169 is inserted into the valve space 181 in a manner capable of moving in an up-down direction. The first opening and closing valve 169 has a base part 169*a* and a shaft part 169*b*. There is a clearance between the base part 169*a* and the case part 168*b* (an inner circumference surface of the valve space 181). This clearance allows communication between an upper side and a lower side of the base part 169*a*. The shaft part 169*b* protrudes downward from the base part 169*a*. In the state shown in FIG. 9, the shaft part 169*b* is protruding downward beyond the inlet hole 168*a*. There is a clearance, in the inlet hole 168*a*, between the shaft part 169*b* and the flange part 180*b*. This clearance allows communication between the upper side and the lower side of the inlet hole 168*a*. A sealing ring 171 is attached to a wall surface of the valve space 181 side of the flange part 180*b*. A coiled spring 170 makes contact with the base part 169*a* of the first opening and closing valve 169. The coiled spring 170 biases the base part 169*a* toward the sealing ring 171. In a normal state (the state where the second joint part 127 is not making contact with the sub tank 117), the base part 169*a* makes contact with the sealing ring 171. The ink path 72 within the first joint part 168 is thus closed by the first opening and closing valve 169.

As shown in FIG. 10, when the second joint part 127 is raised, the first sealing member 166 makes contact with a lower surface of the flange part 180*b* of the sub tank 117. Further, the second sealing member 167 makes contact with the taper part 180*a* of the sub tank 117. The shaft part 163*b* of the second opening and closing valve 163 makes contact with the shaft part 169*b* of the first opening and closing valve 169. The ink path 127*a* of the second joint part 127 and the ink path 72 of the first joint part 168 are opened by the shaft part 163*b* and the shaft part 169*b* pushing against one another.

In the present embodiment, even if ink leaks from the outlet hole 162*a*, this ink is contained by the member 162*b*. It is thus possible to prevent ink from dispersing to the exterior. Further, the ink is contained by the second sealing member 167 even in the case where the ink leaks from the first sealing member 166.

The technique set forth in the above embodiments may be applied to a liquid discharge device other than an ink jet recording device. For example, the technique set forth in the above embodiments may be applied to a device for discharging a solder to make a print circuit. Further, in the above embodiments, the sub tanks 17 and 117 have been configured by forming the first joint parts 68 and 168 and the ink storage chamber 73 integrally. However, the first joint parts 68 and 168 may equally well be configured as separate parts from the ink storage chamber 73. Further, in the above embodiments, the main tank 25 comprises the positive pressure controlling valve 56. However, the main tank 25 may equally well not be provided with the positive pressure controlling valve 56. In that case, the main tank 25 may equally well not be provided with the atmosphere communication hole. That is, a main tank may be adopted that is entirely sealed except for a portion to be connected with the ink supply tube 26.

What is claimed is:

1. A liquid discharge device, comprising:

a discharge head comprising a nozzle for discharging liquid;

a sub tank capable of storing liquid to be supplied to the discharge head; and a liquid replenishment device comprising:

a main tank capable of storing liquid to be supplied to the sub tank; and a joint member to be connected to the main tank;

wherein the joint member is capable of being connected to and disconnected from the sub tank, and the liquid within the main tank is supplied to the sub rank when the joint member is in a connected state with the sub tank;

wherein the joint member comprises a liquid path that opens upward, a valve, and a spring that biases the valve in a direction where the liquid path is closed;

wherein the valve is configured to receive a force from the sub tank and open the liquid path against the biasing force of the spring in a case where the joint member is to be connected to the sub tank; and wherein the valve is configured to further open the liquid path against the biasing force of the spring, due to an inner space of the main tank having a negative pressure greater than a first value, in order to function as a negative pressure controlling valve for the main tank while the joint member is in a disconnected state with the sub tank; and wherein the main tank is not provided with a negative pressure controlling valve.

2. The liquid replenishment device as in claim 1;

wherein the liquid replenishment device further comprises a movement device capable of moving the joint member in a vertical direction; and wherein in a case where the movement device moves the joint member upward, the joint member is connected to the sub tank.

3. The liquid discharge device as claim 1;

wherein the spring constant of the spring is set such that it is capable of preventing the destruction of a meniscus of the nozzle of the discharge head in a case where the negative pressure within the inner space of the main tank is transmitted to the nozzle via the sub tank when the joint member is to be connected to the sub tank.

4. The liquid discharge device as in claim 1, further comprising:

a ring shaped member coupled to the joint member, the ring shaped member extending upward from an upper surface of the joint member, the ring shaped member surrounding the opening of the liquid path.

5. The liquid discharge device as in claim 4;

wherein the ring shaped member is elastically deformable; and wherein the ring shaped member seals between the sub tank and the joint member when the joint member is in the connected state with the sub tank.

6. The liquid discharge device as claim 1;

wherein the main tank comprises a main tank hole located between the inner space of the main tank and the outside of the main tank, and a main tank valve capable of opening and closing the main tank hole; and wherein the main tank valve is configured to open the main tank hole in a case where the inner space of the main tank has a positive pressure greater than a second value.

7. The liquid discharge device as claim 6;

wherein the main tank further comprises a main tank spring biasing the main tank valve toward a direction where the main tank hole is closed; and wherein the spring constant of the main tank spring is set such that it is capable of preventing the destruction of a meniscus of the nozzle of the discharge head in a case where the positive pressure within the inner space of the main tank is transmitted to the nozzle via the sub tank when the joint member is to be connected to the sub tank.

8. The liquid discharge device as in claim 1;

wherein the joint member further comprises a casing;

wherein the casing comprises an upper surface in which a first hole is formed; and wherein the valve comprises a first shaft part which is inserted into the first hole, the first shaft part extending upwards beyond the upper surface of the casing.

9. The liquid discharge device as in claim 8, further comprising:

a ring shaped member coupled to the upper surface of the casing, the ring shaped member extending upward from the upper surface of the joint member, the ring shaped member surrounding the first hole;

wherein the first shaft part extends upwards beyond the ring shaped member.

10. The liquid discharge device as in claim 1;

wherein the sub tank comprises a sub tank side joint member to be coupled with the joint member; and wherein the sub tank side joint member comprises a sub tank side valve.

11. The liquid discharge device as in claim 10;

wherein the sub tank side joint member further comprises a second hole which is formed in a lower wall of the sub tank side joint member; and wherein the sub tank side valve comprises a second shaft part which is inserted into the second hole.

12. The liquid discharge device in claim 11, further comprising;

a ring shaped member coupled to the joint member, the ring shaped member extending upward from the upper surface of the joint member;

wherein the ring shaped member makes contact with the lower wall of the sub tank side joint member when the joint member is in the connected state with the sub tank, whereby a liquid path is formed, via the joint member and the sub tank side joint member, between the main tank and the sub tank.

13. liquid discharge e as in claim 11;

wherein the joint member further comprises a casing;

wherein the casing comprises an upper surface in which a first hole is formed;

wherein the valve comprises a first shaft part which is inserted into the first hole; and wherein an upper end of the first shaft part and a lower end of the second shaft part push each other, whereby both the valve and the sub tank side valve are opened.

14. A liquid discharge device, comprising:

a discharge head comprising a nozzle for discharging liquid;

a sub tank capable of storing liquid to be supplied to the discharge head; and a liquid replenishment device comprising a space for housing a main tank capable of storing liquid to be supplied to the sub tank, and a joint member to be connected to the main tank, wherein the joint member is capable of being connected to and disconnected from the sub tank, and the liquid within the main tank is supplied to the sub tank wherein the joint member is in a connected state with the sub tank;

wherein the joint member comprises a liquid path that opens upward, a valve, and a spring that biases the valve in a direction where the liquid path is closed;

wherein the valve configured to receive a force from the sub tank and open the liquid path against the biasing force of the spring in a case where the joint member is to be connected to the sub tank; and wherein the valve is configured to further open the liquid path against the biasing force of the spring, due to an inner space of the main tank having a negative pressure greater than a first value, in order to function as negative pressure controlling valve for the main tank while the joint member is in a disconnected state with the sub tank; and wherein the main tank is not provided with a negative pressure controlling valve.

15. A liquid discharge device, comprising:

a discharge head comprising a nozzle for discharging liquid;

a sub tank capable of storing liquid to be supplied to the discharge head;

a liquid replenishment device comprising a main tank capable of storing liquid to be supplied to the sub tank, and a joint member to be connected to the main tank, wherein the joint member is capable of being connected to and disconnected from the sub tank, and the liquid within the main tank is supplied to the sub tank when the joint member is in a connected state with the sub tank; and a ring shaped member coupled to the joint member, the ring shaped member extending upward from an upper surface of the joint member;

wherein the joint member comprises a liquid path and a valve, biased in a direction where the liquid path is closed;

wherein the joint member is configured to receive a force from the sub tank and open the liquid path in a case where the joint member is to be connected to the sub tank;

wherein the joint member is configured to open the liquid path in a case where an inner space of the main tank has a negative pressure greater than a first value;

wherein the liquid path opens upward;

wherein the ring shaped member surrounding the opening of the liquid path;

wherein the ring shaped member is elastically deformable; and wherein the ring shaped member seals between the sub tank and the joint member when the joint number is in the connected state with the sub tank.

* * * * *